US005419259A

United States Patent [19]

Theurer et al.

[11] Patent Number: 5,419,259

[45] Date of Patent: May 30, 1995

[54] MACHINE FOR COMPACTING TRACK BALLAST WITH VARIABLE GAUGE TRACK STABILIZER

[75] Inventors: Josef Theurer, Vienna; Wilhelm Praschl, Linz, both of Austria

[73] Assignee: Franz Plasser Bahnbaumaschinen-Industriegesellschaft m.b.H., Vienna, Austria

[21] Appl. No.: 200,070

[22] Filed: Feb. 22, 1994

[30] Foreign Application Priority Data

Mar. 17, 1993 [AT] Austria ..... 532/93

[51] Int. Cl.[6] ..... E01B 33/00

[52] U.S. Cl. ..... 104/7.2; 104/2; 105/178

[58] Field of Search ..... 104/2, 7.1, 7.2, 12; 105/178

[56] References Cited

U.S. PATENT DOCUMENTS

| | | | |
|---|---|---|---|
| 3,486,461 | 1/1968 | Plasser et al. | 104/7.1 |
| 3,926,123 | 12/1975 | Plasser et al. | 104/7.1 |
| 4,046,079 | 9/1977 | Theuer | 104/7.1 |
| 5,113,767 | 5/1992 | Theuier | 104/7.2 |

*Primary Examiner*—Robert J. Oberleitner

*Assistant Examiner*—S. Joseph Morano

*Attorney, Agent, or Firm*—Collard & Roe

[57] ABSTRACT

A mobile machine for compacting ballast comprises a machine frame extending in a longitudinal direction and supported by undercarriages on the track rails, and a ballast bed stabilizing apparatus vertically adjustably mounted on the machine frame. The apparatus comprises a vibrator imparting to the apparatus vibrations extending in a horizontal plane and perpendicularly to the longitudinal direction, flanged rollers spaced apart in a direction extending perpendicularly to the longitudinal direction and supporting the apparatus on the track rails for movement therealong, each flanged roller being mounted on a stub shaft, and a spreading mechanism mounted between the spaced-apart flanged rollers for changing the distance therebetween. According to the invention, the spreading mechanism comprises a multi-position pressure-fluid operated cylinder drive comprising a first cylinder and a second cylinder spaced from first cylinder in the perpendicularly extending direction, a first double-acting piston rod in the first cylinder, a second double-acting piston rod in the second cylinder, and a pivotal connection linking a respective one of the piston rods to a respective one of the stub shafts.

4 Claims, 2 Drawing Sheets

Fig. 1
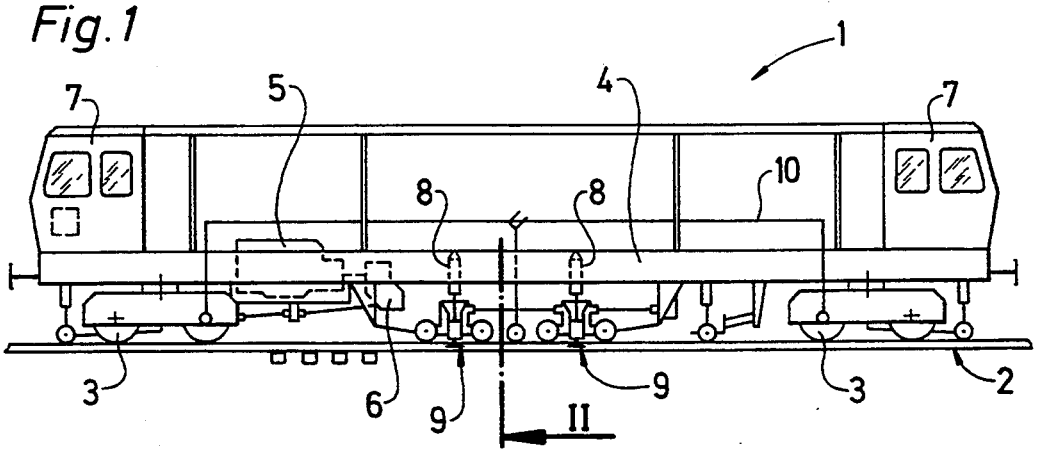
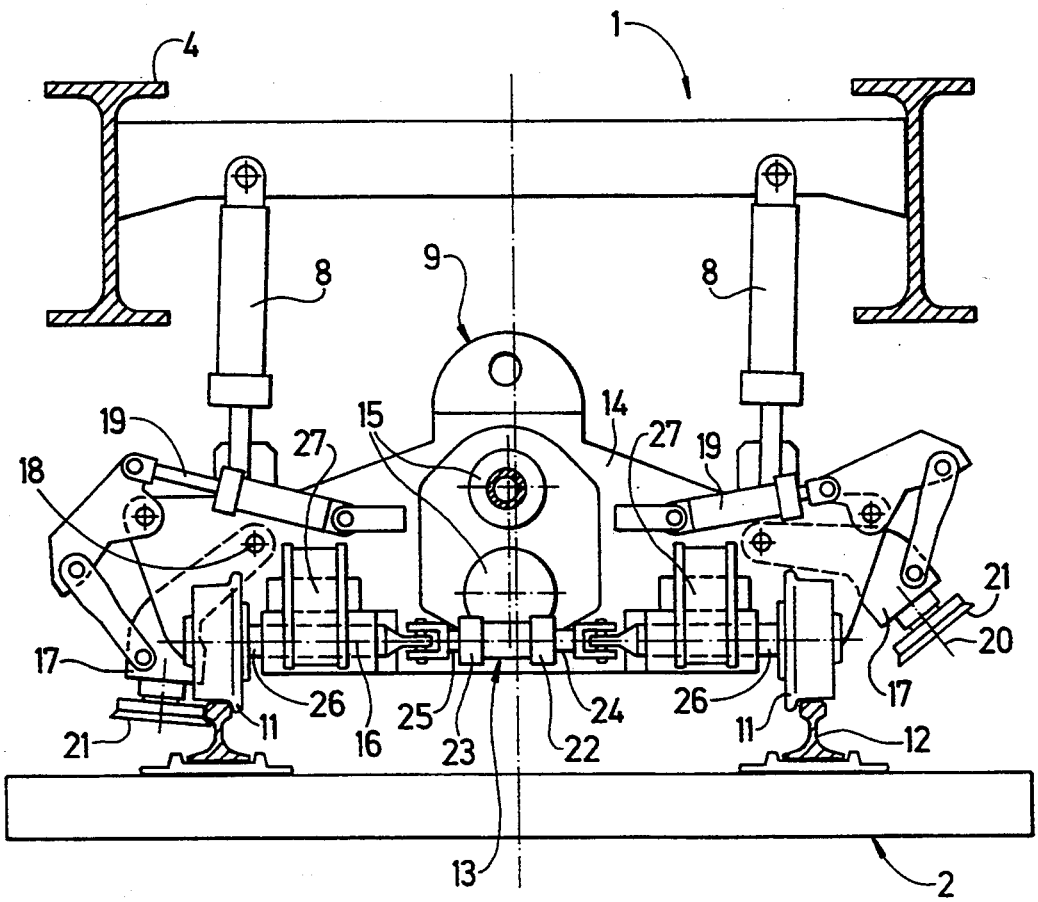
Fig. 2

Fig. 3
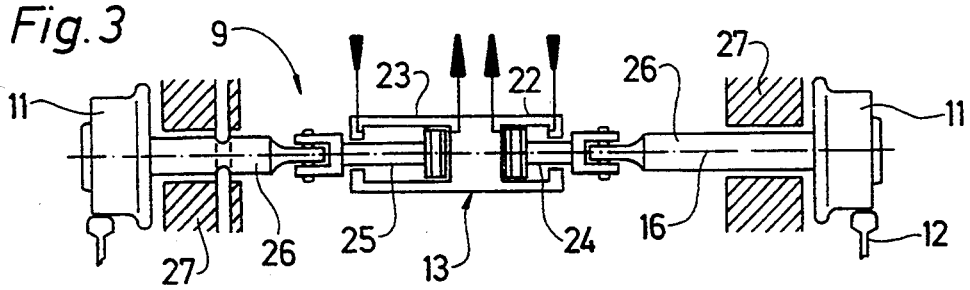
Fig. 4
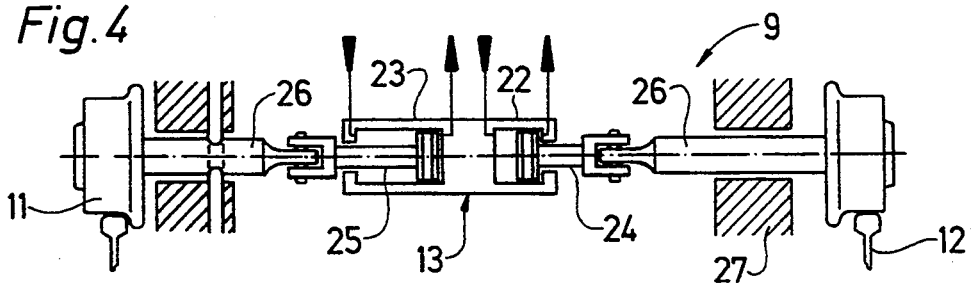
Fig. 5
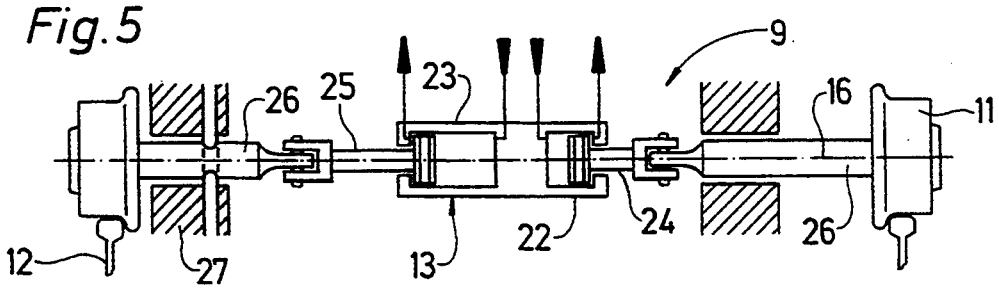
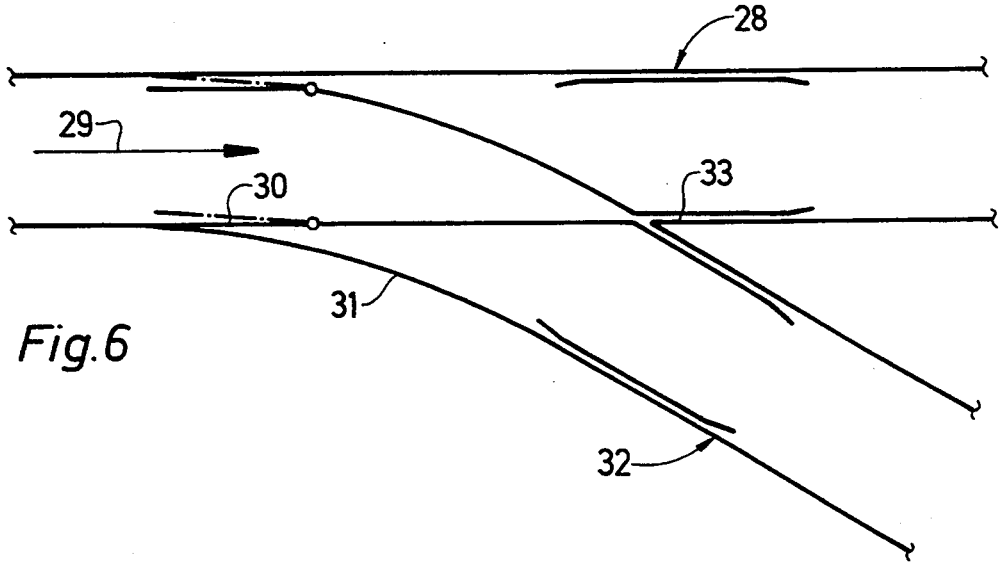
Fig. 6

MACHINE FOR COMPACTING TRACK BALLAST WITH VARIABLE GAUGE TRACK STABILIZER

BACKGROUND OF THE INVENTION

1. Field of the Invention

The present invention relates to a mobile machine for compacting ballast of a ballast bed supporting a track consisting of two rails fastened to ties resting on the ballast bed, which comprises a machine frame extending in a longitudinal direction and supported by undercarriages on the track rails, and a ballast bed stabilizing apparatus vertically adjustably mounted on the machine frame, the apparatus comprising vibrator means imparting to the apparatus vibrations extending in a horizontal plane and perpendicularly to the longitudinal direction, flanged rollers spaced apart in a direction extending perpendicularly to the longitudinal direction and supporting the apparatus on the track rails for movement therealong, each flanged roller being mounted on a stub shaft, and a spreading mechanism mounted between the spaced-apart flanged rollers for changing the distance therebetween.

2. Description of the Prior Art

U.S. Pat. No. 4,046,079 discloses a dynamic ballast stabilization machine of this type, coupled to a ballast tamping machine. The machine comprises a ballast stabilizing apparatus vertically adjustably mounted on a machine frame between the undercarriages supporting the machine frame on the track rails. Flanged rollers support the ballast stabilizing apparatus on the track rails for mobility therealong. Transversely pivotal roller clamps cooperate with the flanged rollers to engage the track rails therebetween without play so that the stabilizing apparatus is held firmly on the track. In conjunction with a static load, vibrators impart vibrations to the apparatus in a horizontal plane and in a direction extending perpendicularly to the longitudinal direction of the machine frame. To prevent any play between the flanged rollers and the track rails whereon they run, a spreading mechanism is arranged therebetween to press the flanges of the rollers against the gage sides of the rail heads.

SUMMARY OF THE INVENTION

It is the primary object of this invention to improve a track stabilizer of the described type by adapting the ballast stabilizing apparatus to problem-free operation in track switches.

The above and other objects are accomplished according to the invention with a mobile ballast compacting machine of the hereinabove described type, wherein the spreading mechanism comprises a multi-position pressure-fluid operated cylinder drive comprising a first cylinder and a second cylinder spaced from the first cylinder in the perpendicularly extending direction, a first double-acting piston rod in the first cylinder, a second double-acting piston rod in the second cylinder, and pivotal means linking a respective one of the piston rods to a respective one of the stub shafts.

Such a spreading mechanism offers the advantageous possibility to change the gage of the flange rollers rapidly and without problems in response to varying operating conditions simply by changing the positions of the piston rods. Three different gages can be selected, the intermediate position readily permitting operation in switches to avoid the danger of derailment or movement along the wrong track. When the smallest gage position is selected, the apparatus can be most easily placed on the track. In the third position, in which the gage is not fixed, the apparatus is operated normally along tangent tracks.

BRIEF DESCRIPTION OF THE DRAWING

The above and other objects, advantages and features of the present invention will become more apparent from the following detailed description of a now preferred embodiment thereof, taken in conjunction with their accompanying, somewhat schematic drawing wherein FIG. 1 shows a mobile ballast compacting machine in side elevation;

FIG. 2 is an enlarged end view taken in the direction of section line II of FIG. 1, illustrating the spreading mechanism of this invention;

FIGS. 3, 4 and 5 are diagrammatic views illustrating three different positions of the pistons of the pressure-fluid operated cylinder drives of the spreading mechanism; and FIG. 6 is a diagrammatic top view of a track switch.

DETAILED DESCRIPTION OF THE PREFERRED EMBODIMENT

Referring now to the drawing and first to FIG. 1, there is shown mobile machine 1 for compacting ballast of a ballast bed supporting track 2 consisting of two rails 12 fastened to ties resting on the ballast bed. Such machines are known as dynamic track stabilizers and have been used with great success in track rehabilitation work. The machine comprises machine frame 4 extending in a longitudinal direction and supported by undercarriages 3 on track rails 12. The machine frame carries power plant 5 for supplying energy to the operating drives of the machine, a drive 6 for moving the machine along the track, and operating cabs 7. Furthermore, two ballast bed stabilizing units 9, 9 are vertically adjustably mounted below machine frame 4 by pressure-fluid operated drives 8. Reference system 10 controls the level of the track produced by operation of the vertically adjustable stabilizing apparatuses, all in a manner well known in the art and described, for example, in the above-identified patent.

As is also conventional, each ballast stabilizing apparatus 9 comprises housing 14 linked to machine frame 4 by a pair of hydraulic drives 8 for vertical adjustment and carrying vibrators 15 comprised of crank drives imparting to the apparatus vibrations extending in a horizontal plane and perpendicularly to the longitudinal direction. Two pairs of flanged rollers 11, which are spaced apart in a direction extending perpendicularly to the longitudinal direction, support apparatus 9 on track rails 12 for movement therealong, and each flanged roller 11 is mounted on a stub shaft 26 for rotation about axis 16. The vibrations of apparatus 9 extend in a direction parallel to rotary axes 16. A respective roller clamp 17 is mounted on housing 14 for cooperation with each flanged roller, each roller clamp being pivotal about axis 18 extending in the longitudinal direction of machine frame 4. A respective pressure-fluid operated drive 19 links each roller clamp 17 to housing 14 for pivoting the roller clamp into and out of engagement with respective track rail 12. Each roller clamp carries roller 21 at a lower end thereof, roller 21 being freely rotatable about axis 20. All of this structure is known.

As shown in FIG. 2, spreading mechanism 13 is mounted between spaced-apart flanged rollers 11 of each pair of flanged rollers for changing the distance therebetween, i.e. the gage. The illustrated spreading mechanism comprises a multi-position pressure-fluid operated cylinder drive comprising a first cylinder 22 and a second cylinder 23 spaced from the first cylinder in the perpendicularly extending direction. The first cylinder has a first double-acting piston rod 24, and the second cylinder has a second double-acting piston rod 25. Pivotal means links a respective one of the piston rods 24, 25 to a respective one of the stub shafts 26 of flanged rollers 11.

In the illustrated embodiment, housing 14 defines a first bearing 27 for one of the stub shafts 26 and a second bearing 27 for the other one of the stub shafts 26, the one stub shaft 26 shown on the right side of FIG. 2 being displaceably mounted in the first bearing and the other stub shaft shown on the left side of FIG. 2 being fixedly mounted in the second bearing. In this embodiment and as shown, first and second cylinders 22, 23 are coaxially arranged and are combined in a structural unit.

As illustrated in FIGS. 3 to 5, piston rods 24, 25 have different lengths of stroke. The first piston rod 24 has a length of stroke of 15 mm and second piston rod 25 has a length of stroke of 45 mm. FIG. 3 shows the piston rods in their retracted position so that the flanged rollers 11 are set at their smallest gage of 1420 mm, which is a little less than the standard track gage and enables apparatus 9 to be readily placed on the track before beginning a ballast stabilizing operation. In the piston rod setting illustrated in FIG. 4, second piston rod 25, which has the longer length of stroke, is retracted while first piston rod 24 has been extended. This produces a gage of 1435 mm for flanged rollers 11, which corresponds to the standard track gage. As will be explained more fully in connection with FIG. 6, this piston rod position can be used for operation in switches. Finally, FIG. 5 shows both piston rods 24, 25 extended, the gage of flanged rollers 11 resulting from the prevalent track gage and the yielding resilience of the fastening elements fastening the track rails to the ties. In other words, in this position flanged rollers 11 will firmly engage the gage sides of the heads of rails 12, regardless of any faults in the track gage.

In operation along a tangent track and as machine 1 approaches switch 28 in the direction indicated by arrow 29, as illustrated in FIG. 6, rail clamps 17 of each ballast stabilizing apparatus 9 are pivoted downwardly into engagement with track rails 12, and spreading mechanisms 13 are in the position shown in FIG. 5. Just before the machine reaches switch tongue 30, that is to say where rail 31 of branch track 32 branches off the main track, rail clamps 17 at the right side of ballast stabilizing units 9, i.e. at indicated switch tongue 30, are raised out of engagement with the track rail (see FIG. 2). Simultaneously, spreading mechanisms 13 are operated to assume the position shown in FIG. 4, i.e. hydraulic fluid is delivered to cylinder 23 to retract piston rod 25. In this position, left rail 12 remains firmly gripped between rail clamps 17 and cooperating flanged rollers 11 (see FIG. 2) so that the horizontal vibrations of ballast stabilizing units 9 are transmitted to the track through the left rail while there is the standard play between right flanged rollers 11 and the gage side of the head of right rail 12 (see FIG. 4). Immediately after machine 1 has passed switch tongue 30, right rail clamps 17 are lowered again to engage right track rail 12 while piston rod 25 is simultaneously extended again back into the position shown in FIG. 5, i.e. both rails are firmly gripped. Immediately before reaching frog 33, the above-described operation of spreading mechanisms 13 of ballast stabilizing units 9 is repeated, i.e. rail clamps 17 at the right side are raised and piston rods 25 are retracted.

What is claimed is:

1. A mobile machine for compacting ballast of a ballast bed supporting a track consisting of two rails fastened to ties resting on the ballast bed, the track rails having facing gage sides, which comprises (a) a machine frame extending in a longitudinal direction and supported by undercarriages on the track rails, and (b) a ballast bed stabilizing apparatus vertically adjustably mounted on the machine frame, the apparatus comprising (1) vibrator means imparting to the apparatus vibrations extending in a horizontal plane and perpendicularly to the longitudinal direction, (2) flanged rollers spaced apart in a direction extending perpendicularly to the longitudinal direction and supporting the apparatus on the track rails for movement therealong, each flanged roller having a single flange for engaging the gage side of a respective one of the track rails and being mounted on a stub shaft, (3) a housing defining a first bearing for one of the stub shafts and a second bearing for the other one of the stub shafts, the one stub shaft being displaceably mounted in the first bearing and the other stub shaft being fixedly mounted in the second bearing, (4) a roller clamp cooperating with at least one of the flanged rollers for holding a respective one of the track rails therebetween, and (5) a spreading mechanism mounted between the spaced-apart flanged rollers for changing the distance therebetween, wherein the spreading mechanism comprises a multi-position pressure-fluid operated cylinder drive comprising a first cylinder and a second cylinder spaced from the first cylinder in the perpendicularly extending direction, a first double-acting piston rod in the first cylinder, a second double-acting piston rod in the second cylinder, and pivotal means linking a respective one of the piston rods to a respective one of the stub shaft.

2. The mobile ballast compacting machine of claim 1, wherein the first and second cylinders are coaxially arranged and combined in a structural unit.

3. The mobile ballast compacting machine of claim 2, wherein the piston rods have different lengths of stroke.

4. The mobile ballast compacting machine of claim 3, wherein the first piston rod has a length of stroke of 15 mm and the second piston rod has a length of stroke of 45 mm.

* * * * *